US009862207B2

(12) United States Patent
Tsutsui et al.

(10) Patent No.: US 9,862,207 B2
(45) Date of Patent: Jan. 9, 2018

(54) DRYING DEVICE, PRINTING APPARATUS, AND DRYING METHOD

(71) Applicant: SCREEN Holdings Co., Ltd., Kyoto-shi, Kyoto (JP)

(72) Inventors: Yuki Tsutsui, Kyoto (JP); Hirotake Nishimura, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/376,732

(22) Filed: Dec. 13, 2016

(65) Prior Publication Data

US 2017/0173973 A1 Jun. 22, 2017

(30) Foreign Application Priority Data

Dec. 16, 2015 (JP) ..... 2015-245338

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

2003/0086737 A1* 5/2003 Shida ..... G03G 15/2053 399/330
2004/0009020 A1* 1/2004 Shimizu ..... H05B 6/145 399/328
2006/0089314 A1* 4/2006 Wakahara ..... G03G 15/2053 399/330

FOREIGN PATENT DOCUMENTS

JP 2015-178230 A 10/2015

* cited by examiner

*Primary Examiner* — Lamson Nguyen
(74) *Attorney, Agent, or Firm* — McDermott Will & Emery LLP

(57) ABSTRACT

A drying device includes a cooling unit, a gas outward guide unit, a gas inward guide unit, a gas supply unit, and a gas exhaust unit. The cooling unit feeds cooling wind toward a part near a heat source. The gas outward guide unit guides gas outwardly from the part near the heat source. The gas inward guide unit guides the outwardly-guided gas inwardly into the drying chamber. The gas supply unit supplies the inwardly-guided gas in the drying chamber to a neighborhood of an outer peripheral surface of the heat roller. The gas exhaust unit releases gas from a surrounding of the heat roller to the outside of a printing apparatus. Thus, high-temperature gas with heat absorbed from the part near the heat source is fed to the surrounding of the heat roller. This reduces humidity increase in the surrounding of the heat roller and reduces temperature drop of the heat roller, compared to feeding gas at ordinary temperature. Further, diffusion of the high-temperature gas in the printing apparatus is prevented.

15 Claims, 7 Drawing Sheets

DRYING DEVICE, PRINTING APPARATUS, AND DRYING METHOD

BACKGROUND OF THE INVENTION

Field of the Invention

The present invention relates to a drying device that dries ink adhering to an elongated strip-shaped printing medium, a printing apparatus including the drying device, and a drying method of drying ink adhering to an elongated strip-shaped printing medium.

Description of the Background Art

In a printing apparatus conventionally known, an image is recorded on elongated strip-shaped printing paper by ejecting ink toward the printing paper while the printing paper is transported in its longitudinal direction. Some printing apparatus of this type includes a drying mechanism employing a heat roller system. The drying mechanism employing the heat roller system heats and dries ink by making printing paper contact a surface of a heated heat roller.

The conventional printing apparatus including the drying mechanism employing the heat roller system is described in Japanese Patent Application Laid-Open No. 2015-178230, for example.

The heat roller includes a heat source such as a halogen lamp arranged inside the heat roller. When a drying process is performed, a member arranged near the heat source is increased in temperature together with the heat source. Hence, according to the drying mechanism employing the heat roller system, the member near the heat source may be cooled through blowing of gas with the intention of preventing damage of this member due to excessive temperature increase. However, if the gas brought to high temperature by absorption of heat from the member diffuses in the printing apparatus, temperature inside the apparatus may be increased to cause adverse effect on a different place in the apparatus. This may be handled by providing a temperature adjusting mechanism separately for adjusting temperature in the apparatus. However, adding the temperature adjusting mechanism substantially increases manufacturing cost for the printing apparatus.

Meanwhile, a vaporized solvent component in the ink increases the humidity of the gas (a content of the solvent component in the gas) in a neighborhood of the surface of the heat roller during the drying process. Hence, for increasing drying efficiency, it is preferable that the gas in the neighborhood of the surface of the heat roller be always replaced by fresh gas. However, supplying gas at ordinary temperature to the neighborhood of the surface of the heat roller reduces the temperature of the heat roller. This may work contrarily to reduce drying efficiency.

SUMMARY OF THE INVENTION

The present invention is intended to provide a drying device, a printing apparatus, and a drying method capable of reducing humidity increase in a surrounding of a heat roller, reducing temperature drop of the heat roller, and preventing gas brought to high temperature by air cooling of a part near a heat source from diffusing in the printing apparatus.

The present invention is intended for a drying device installed on a printing apparatus that records an image on an elongated strip-shaped printing medium by an inkjet system. The drying device is for drying ink adhering to the printing medium. The drying device comprises: a drying chamber provided in the printing apparatus; a heat roller that rotates about a rotation axis extending parallel to a width direction of the printing medium while supporting the printing medium on an outer peripheral surface of the heat roller in the drying chamber; a heat source provided in the heat roller; a cooling unit that feeds cooling wind from a place lateral to the heat roller toward a part near the heat source; a gas outward guide unit that guides gas outwardly from the part near the heat source to the outside of the drying chamber; a gas inward guide unit that guides gas inwardly into space external to the heat roller and inside the drying chamber, the inwardly-guided gas being the gas guided outwardly by the gas outward guide unit; a gas supply unit that supplies gas to a neighborhood of the outer peripheral surface of the heat roller, the supplied gas being the gas guided inwardly by the gas inward guide unit; and a gas exhaust unit that releases gas from a surrounding of the heat roller to the outside of the printing apparatus.

According to the present invention, high-temperature gas with heat absorbed from the part near the heat source is fed to the surrounding of the heat roller. This reduces humidity increase in the surrounding of the heat roller and reduces temperature drop of the heat roller, compared to feeding gas at ordinary temperature. As a result, drying efficiency is increased. Further, diffusion of the high-temperature gas in the printing apparatus is reduced.

DESCRIPTION OF THE PREFERRED EMBODIMENTS

A preferred embodiment according to the present invention will now be described with reference to the drawings.

<1. Configuration of Printing Apparatus>

Figure 1:
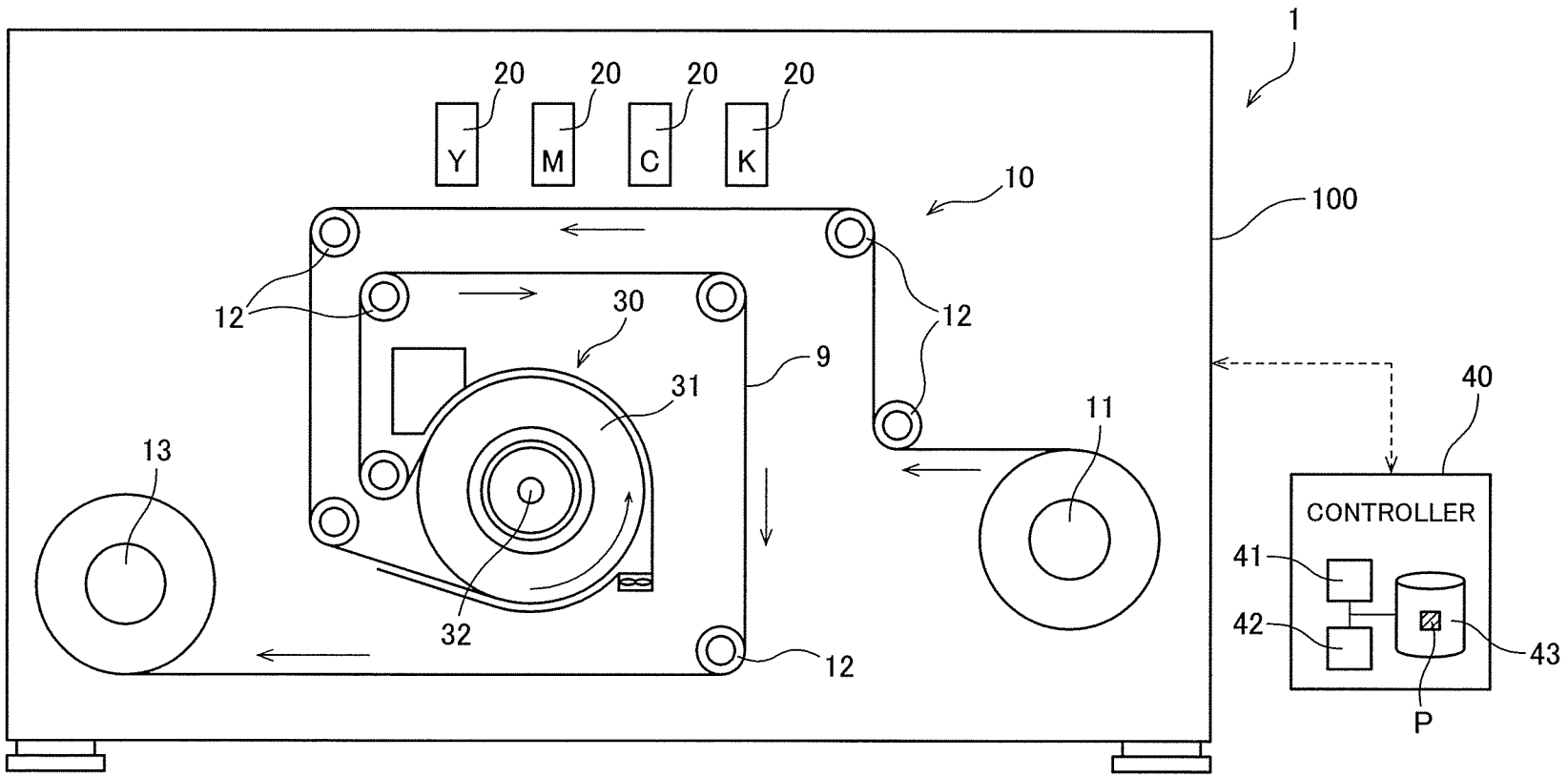
FIG. 1 shows the configuration of a printing apparatus.

FIG. 1 shows the configuration of a printing apparatus 1 according to one preferred embodiment of the present invention. The printing apparatus 1 is an apparatus that records an image on a surface of printing paper 9 that is an elongated strip-shaped printing medium by an inkjet system while transporting the printing paper 9. As shown in FIG. 1, the printing apparatus 1 includes a transport mechanism 10, four head units 20, a drying device 30, and a controller 40. The transport mechanism 10, the four head units 20, and the drying device 30 are housed in an outer housing 100 of the printing apparatus 1.

The transport mechanism 10 is a mechanism for transporting the printing paper 9 in a transport direction along the length of the printing paper 9. The transport mechanism 10 of the preferred embodiment includes an unwinding roller 11, a plurality of transport rollers 12, and a winding roller 13. A motor as a power source (not shown in the drawings) is connected to some of the rollers of the transport mechanism 10. When the motor is operated, the printing paper 9 is unwound from the unwinding roller 11. Then, the printing paper 9 is transported along a transport path formed of the transport rollers 12. Each of the transport rollers 12 rotates about a horizontal axis to guide the printing paper 9 downstream along the transport path. After being transported, the printing paper 9 is collected on the winding roller 13.

Some structure of the transport mechanism 10 may be independent of different structures. For example, only a structure of the transport mechanism 10 including the winding roller 13 may be separated from the other structures of the transport mechanism 10.

The four head units 20 are mechanisms that ejects ink toward the printing paper 9 being transported by the transport mechanism 10. The printing apparatus 1 is a printing apparatus employing what is called a one-pass system of recording an image on the printing paper 9 by ejecting ink droplets from each of the head units 20 while the printing paper 9 passes through under the four head units 20 only once. As shown in FIG. 1, the printing paper 9 moves below the four head units 20 and substantially horizontally in a direction where the head units 20 are arranged. While the printing paper 9 moves, a recording surface of the printing paper 9 is pointed upward (toward the head units 20). The four head units 20 eject ink droplets of corresponding colors including black (K), cyan (C), magenta (M), and yellow (Y) as color components of a multicolor image onto the recording surface of the printing paper 9.

Figure 2:
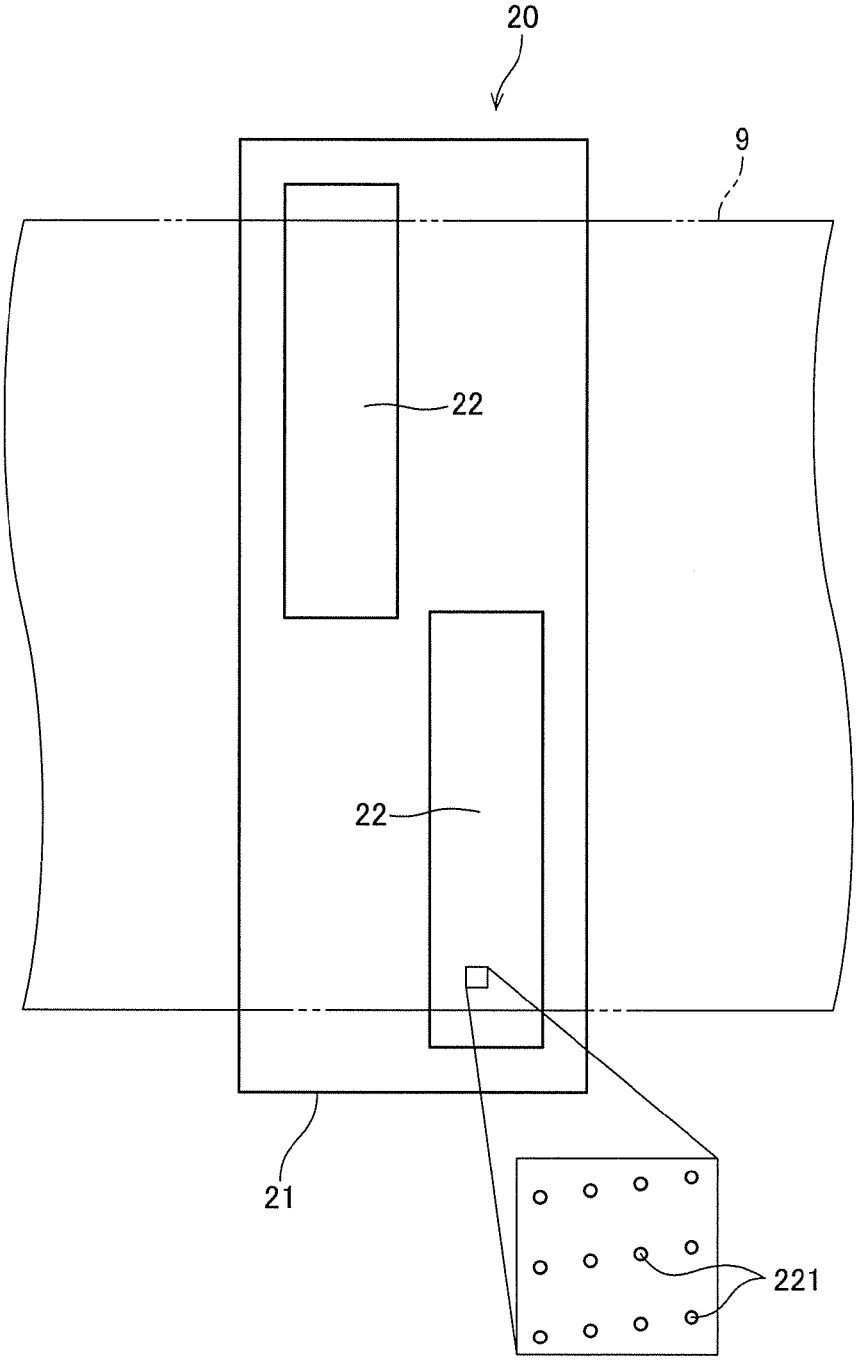
FIG. 2 is a bottom view of a head unit.

The respective configurations of the four head units 20 themselves are substantially the same, while the head units 20 are to eject ink of different colors. FIG. 2 is a bottom view of one of the head units 20. As shown in FIG. 2, the head unit 20 of this preferred embodiment includes a case 21 and two recording heads 22 fixed to the case 21. Each of the two recording heads 22 has an ejection surface exposed at the lower surface of the case 21. As shown in FIG. 2, the two recording heads 22 are located at positions shifted in the transport direction. Further, the positions of the two recording heads 22 are also shifted in a width direction of the printing paper 9 (a horizontal direction orthogonal to the transport direction) so as to cover an entire region of the printing paper 9 in the width direction.

As shown in an enlarged part of FIG. 2, the lower surface of each recording head 22 is provided with a plurality of nozzles 221 arranged regularly. The nozzles 221 are arranged at positions shifted from each other in the width direction. One nozzle 221 is allocated to a region having a width corresponding to one pixel on the printing paper 9. During printing, ink droplets are ejected from the nozzles 221 of each recording head 22 toward the recording surface of the printing paper 9. In this way, the four head units 20 record single-color images on the recording surface of the printing paper 9. The four single-color images are superimposed to form a multicolor image on the recording surface of the printing paper 9.

One head unit 20 may include one recording head 22, or three recording heads 22 or more. The printing apparatus 1 may include one head unit 20, three head units 20 or less, or five head units 20 or more. For example, the printing apparatus 1 may include a head unit for ejecting ink of a spot color in addition to the four head units 20 for ejecting ink of different colors including black, cyan, magenta, and yellow.

The drying device 30 is a device that dries ink adhering to the printing paper 9. The drying device 30 is arranged downstream of the four head units 20 on the transport path. As shown in FIG. 1, the drying device 30 includes a heat roller 31 and a halogen lamp provided in the heat roller 31. The heat roller 31 is a circular cylindrical roller having a larger outer diameter than the transport rollers 12. The heat roller 31 rotates about a rotation axis extending parallel to the width direction of the printing paper 9. The halogen lamp 32 is a heat source for heating the heat roller 31. When a driving current is supplied to the halogen lamp 32, the halogen lamp 32 emits light to heat the heat roller 31.

After ink is ejected from the four head units 20 on the printing paper 9, the printing paper 9 is transported into the drying device 30. In the drying device 30, the heat roller 31 transports the printing paper 9 by rotating while supporting the printing paper 9 on the heat roller 31. At this time, an outer peripheral surface of the heat roller 31 contacts a rear surface (a surface opposite the recording surface) of the printing paper 9. Heat generated by the halogen lamp 32 and stored in the heat roller 31 is transferred from the outer peripheral surface of the heat roller 31 to the printing paper 9. In this way, a solvent in the ink adhering to the recording surface of the printing paper 9 is vaporized to dry the ink.

The configuration of the drying device 30 will be described in more detail later.

The controller 40 is a unit for controlling the operation of each structure in the printing apparatus 1. As conceptually shown in FIG. 1, the controller 40 is formed of a computer including an arithmetic processor 41 such as a CPU, a memory 42 such as a RAM, and a storage 43 such as a hard disk drive. The storage 43 stores an installed computer program P used for performing a printing process including a drying process described later.

Figure 3:
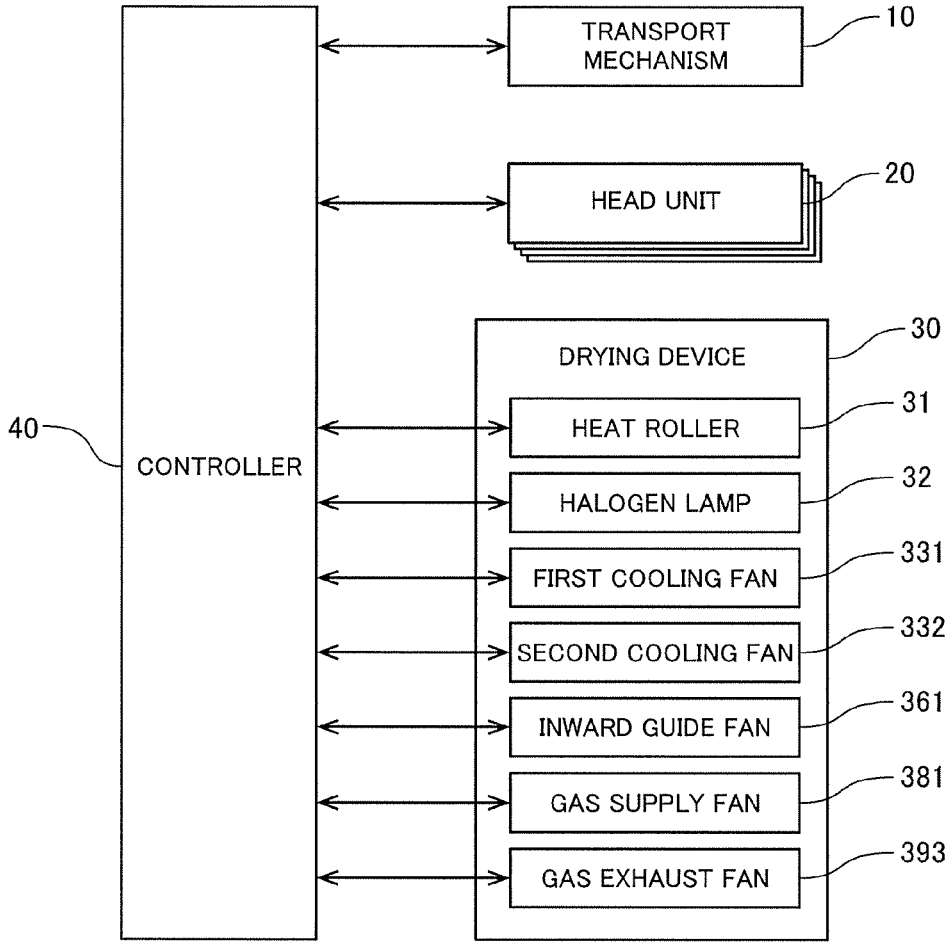
FIG. 3 is a block diagram showing a connection between a controller and each structure in the printing apparatus.

FIG. 3 is a block diagram showing a connection between the controller 40 and each structure in the printing apparatus 1. As shown in FIG. 3, the controller 40 is connected to the aforementioned transport mechanism 10, four head units 20, and drying device 30 (including the heat roller 31, the halogen lamp 32, and a first cooling fan 331, a second cooling fan 332, an inward guide fan 361, a gas supply fan 381, and a gas exhaust fan 393, all of which will be described later) in a manner that allows communication between the controller 40 and each of the connected structures. The controller 40 temporarily reads the computer program P from the storage 43 onto the memory 42 and makes the arithmetic processor 41 perform arithmetic processing based on the read computer program P, thereby controlling the operation of each of the aforementioned structures. In this way, the printing process proceeds in the printing apparatus 1.

<2. Configuration of Drying Device>

Figure 4:
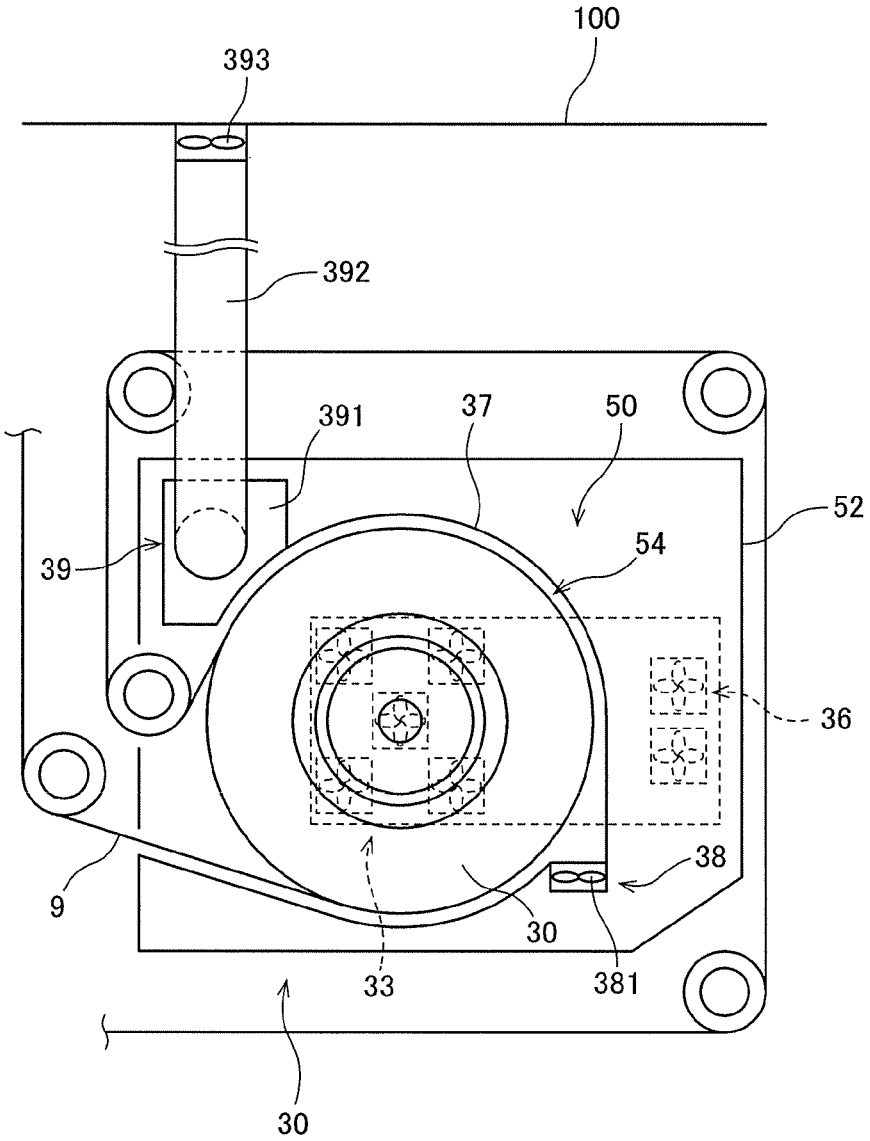
FIG. 4 shows a drying device and its neighborhood viewed from one side of a width direction.
Figure 5:
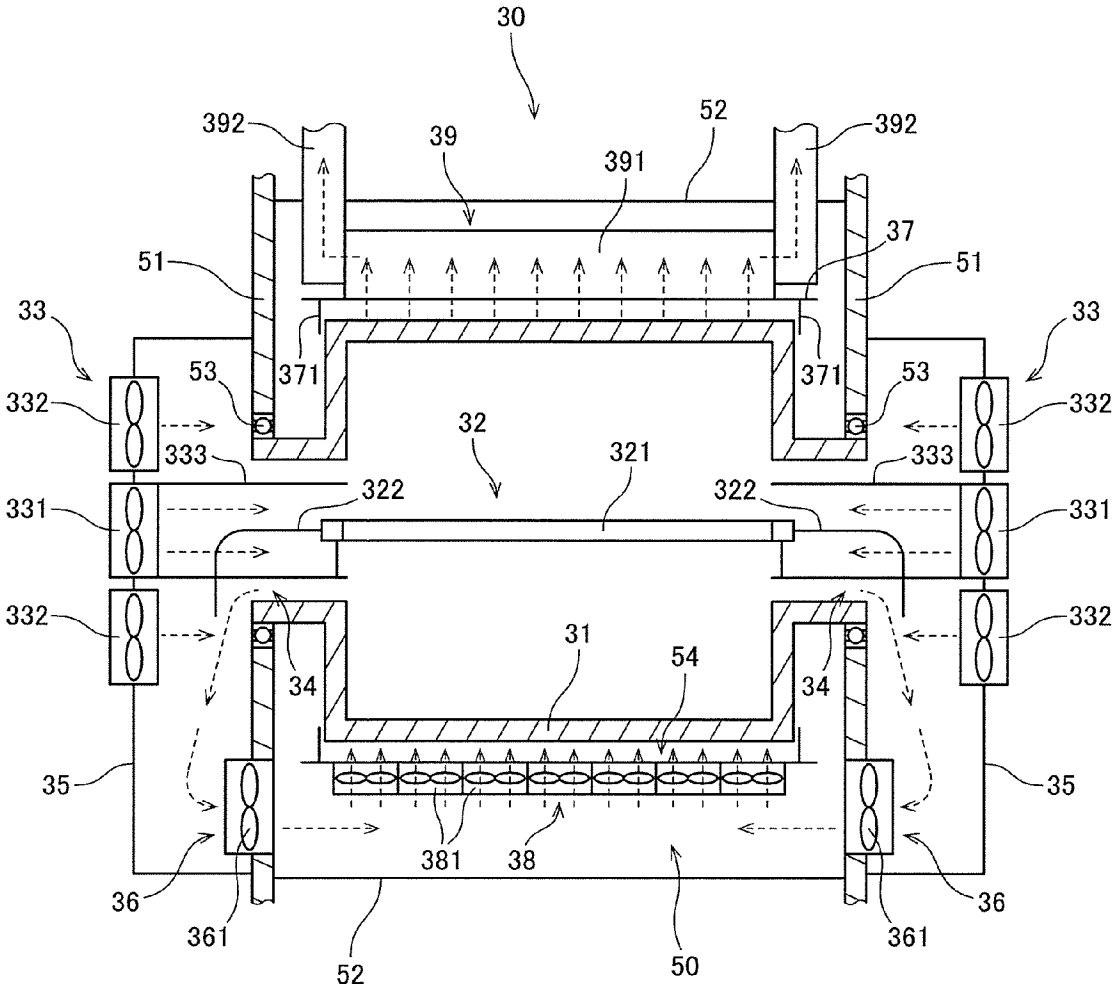
FIG. 5 is a sectional view taken along a plane including a rotation axis of a heat roller and showing the drying device and its neighborhood.

The configuration of the drying device 30 is described next in more detail. FIG. 4 shows the drying device 30 and its neighborhood viewed from one side of the width direction. FIG. 5 is a sectional view taken along a plane including the rotation axis of the heat roller 31 and showing the drying device 30 and its neighborhood.

As shown in FIGS. 4 and 5, a drying chamber 50 is provided in the outer housing 100 of the printing apparatus 1. The drying chamber 50 is defined by side walls 51 in a pair extending vertically to the width direction, and a partition 52 extending in the width direction between the side walls 51 in a pair. The heat roller 31 has opposite end portions in the width direction that are attached to through holes formed in the side walls 51 in a pair via bearings 53. In this way, the heat roller 31 is rotatably supported on the side walls 51 in a pair. Ball bearings are used as the bearings 53, for example.

The halogen lamp 32 includes a columnar light-emitting part 321 extending in the width direction, and terminals 322 in a pair provided at the opposite ends of the light-emitting part 321. The light-emitting part 321 is arranged inside the heat roller 31. Both the terminals 322 in a pair extend to the outside of the side walls 51 via openings provided at the opposite ends of the heat roller 31. When the printing process is performed, a driving current is supplied from an external power source to the light-emitting part 321 via the terminals 322. This generates light emission at the light-emitting part 321 to heat the heat roller 31. At this time, the temperatures of the terminals 322 and the temperatures of the bearings 53 arranged near the light-emitting part 321 are also increased.

As shown in FIGS. 4 and 5, the drying device 30 of this preferred embodiment includes a cooling unit 33, a gas outward guide unit 34, a relay duct 35, a gas inward guide unit 36, a guide plate 37, a gas supply unit 38, and a gas exhaust unit 39 that form a mechanism for controlling a gas flow around the heat roller 31. The cooling unit 33, the gas outward guide unit 34, the relay duct 35, and the gas inward guide unit 36 include cooling units 33, gas outward guide units 34, relay ducts 35, and gas inward guide units 36, all of which are provided in pairs at the opposite sides of the heat roller 31 in the width direction.

The cooling units 33 are air-cooling mechanisms for reducing temperature increase of the terminals 322 and temperature increase of the bearings 53. Each of the cooling units 33 includes one first cooling fan 331 that feeds cooling wind toward the terminal 322, and a plurality of second cooling fans 332 that feeds cooling wind toward the bearing 53. Each of the first cooling fan 331 and the second cooling fans 332 generates cooling wind in such a manner that the cooling wind blows parallel to the rotation axis of the heat roller 31 from outside to inside the side wall 51.

When the cooling wind blows on the terminal 322 and the bearing 53, heat of the terminal 322 and heat of the bearing 53 are absorbed by gas forming the cooling wind. In this way, temperature increase of the terminal 322 and temperature of the bearing 53 are reduced. In particularly, in this preferred embodiment, a flow guide tube 333 is provided to extend from the first cooling fan 331 toward the inside of the heat roller 31. The terminal 322 is arranged inside the flow guide tube 333. This allows the cooling wind generated by the first cooling fan 331 to blow efficiently on the terminal 322.

The gas outward guide unit 34 is a structure by which the gas placed at high temperature by absorption of the heat from the terminal 322 and the bearing 53 is guided outwardly to space outside the drying chamber 50. In this preferred embodiment, the gas having blown from the first cooling fan 331 on the terminal 322 passes through an annular gap between an outer peripheral surface of the flow guide tube 333 and an inner peripheral surface of an end portion of the heat roller 31 to be guided to the outside of the drying chamber 50. The gas having blown from the second cooling fans 332 on the bearing 53 bounces off the bearing 53 to be guided to the outside of the drying chamber 50.

In this preferred embodiment, the gas outward guide unit 34 does not include a dedicated fan but the gas outward guide unit 34 for outward guide of the high-temperature gas to the outside of the drying chamber 50 is formed by using the configurations of the flow guide tube 333, the heat roller 31, and the side walls 51. Meanwhile, the gas outward guide unit 34 may include a fan for generating a gas flow positively.

The relay duct 35 is a pipe provided outside each of the side walls 51 in a pair and serving as a channel for connecting the gas outward guide unit 34 and the gas inward guide unit 36. In this preferred embodiment, the high-temperature gas guided outwardly from the terminal 322 and the bearing 53 to the outside of the drying chamber 50 flows in the relay duct 35. This reduces diffusion of the high-temperature gas outside the drying chamber 50. As a result, the gas flows efficiently in the relay duct 35.

The gas inward guide unit 36 is a mechanism by which the gas guided outwardly into the relay duct 35 by the gas outward guide unit 34 is guided inwardly into space external to the heat roller 31 and inside the drying chamber 50. The gas inward guide unit 36 of this preferred embodiment includes the inward guide fan 361 provided at the side wall 51. Driving the inward guide fan 361 generates a gas flow toward the inside of the drying chamber 50 via the inward guide fan 361. In this way, the high-temperature gas in the relay duct 35 is guided inwardly into the space external to the heat roller 31 and inside the drying chamber 50.

The guide plate 37 is a plate-like curved member extending along the outer peripheral surface of the heat roller 31. The outer peripheral surface of the heat roller 31 and the guide plate 37 face each other while a slight gap is formed therebetween. In this way, arc-shaped narrow and small space (hereinafter called "arc-shaped space 54") is formed between the outer peripheral surface of the heat roller 31 and the guide plate 37 in a side view. The printing paper 9 is subjected to the drying process with the heat roller 31 in the arc-shaped space 54.

As shown in FIG. 5, the guide plate 37 of this preferred embodiment includes blades 371 in a pair. The blades 371 in a pair cover opposite end portions of the arc-shaped space 54 in the width direction. This reduces diffusion of gas further in the arc-shaped space 54.

The gas supply unit 38 is a mechanism by which the gas guided inwardly into the drying chamber 50 by the gas inward guide unit 36 is supplied to a neighborhood of the outer peripheral surface of the heat roller 31. The gas supply unit 38 of this preferred embodiment includes a plurality of gas supply fans 381. The gas supply fans 381 are attached to the guide plate 37. The gas supply fans 381 are arranged in the width direction to cover the substantially entire width of the heat roller 31 in the width direction. Driving the gas supply fans 381 makes each of the gas supply fans 381 generate a gas flow from space outside the guide plate 37 toward the arc-shaped space 54.

Figure 6:
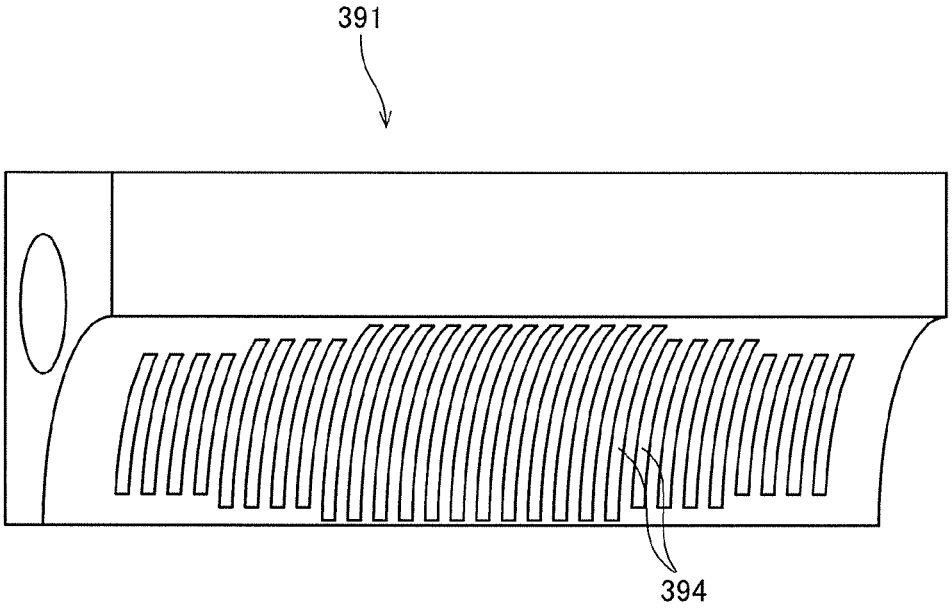
FIG. 6 is a perspective view of a suction part.

The gas exhaust unit 39 is a mechanism for releasing the gas from a surrounding of the heat roller 31 to the outside of the outer housing 100. As shown in FIGS. 4 and 5, the gas exhaust unit 39 of this preferred embodiment includes a suction part 391, gas exhaust ducts 392 in a pair, and gas exhaust fans 393 in a pair. The suction part 391 is attached to the guide plate 37 at a position downstream of the gas supply unit 38 on the transport path of the printing paper 9. FIG. 6 is a perspective view of the suction part 391. As shown in FIG. 6, a surface of the suction part 391 closer to the heat roller 31 is provided with a plurality of suction holes 394 like slits arranged in the width direction. The gas exhaust ducts 392 in a pair connect opposite end portions of the suction part 391 in the width direction and space outside the outer housing 100. The gas exhaust fans 393 are provided at positions near outer end portions of the corresponding gas exhaust ducts 392 in a pair.

When the gas exhaust fan 393 is driven, a gas flow is generated in the gas exhaust duct 392 and the suction part 391 to travel toward the outside of the outer housing 100. Thus, the gas in the arc-shaped space 54 passes through the suction holes 394 to be sucked into the suction part 391. This gas also passes through the suction part 391 and the gas exhaust duct 392 to be released to the outside of the outer housing 100.

For the implementation of the printing process, both the gas supply fans 381 and the gas exhaust fans 393 in a pair are driven. By doing so, high-humidity gas containing a solvent component evaporated from ink is released to the outside of the outer housing 100 by the gas exhaust unit 39. Further, low-humidity gas is supplied to the arc-shaped space 54 by the gas supply unit 38. Specifically, gas in the arc-shaped space 54 is always replaced by low-humidity gas. This reduces humidity increase in the arc-shaped space 54. As a result, the drying process with the heat roller 31 proceeds more efficiently.

Figure 7:
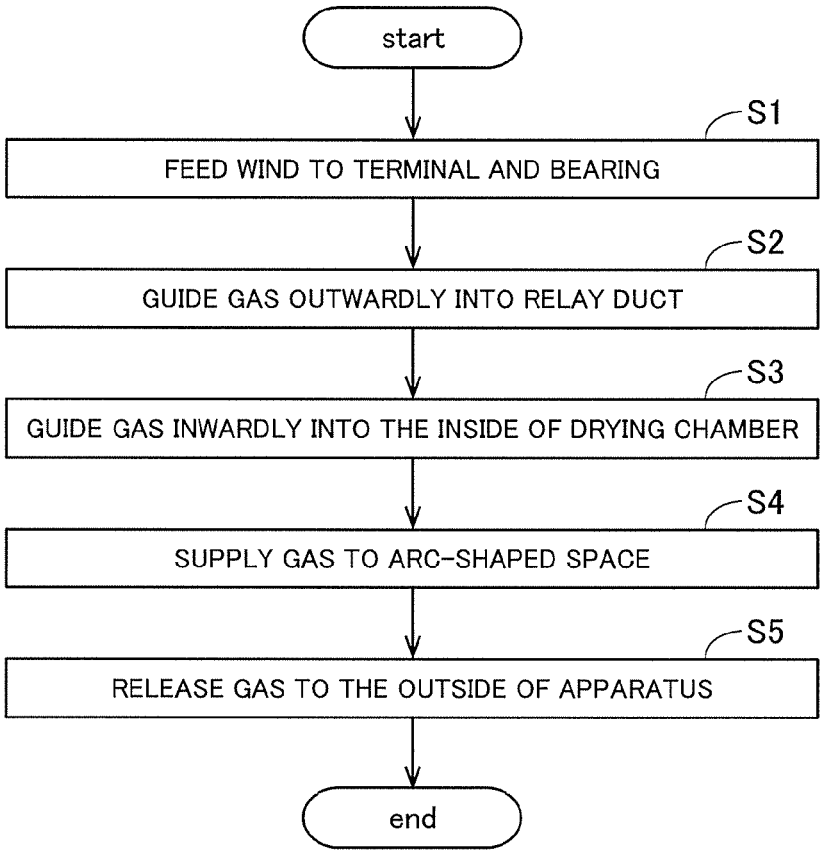
FIG. 7 is a flowchart showing a flow of gas in the drying device in sequence.

FIG. 7 is a flowchart showing a flow of gas in the drying device 30 in sequence. As described above, in the drying device 30, cooling wind is fed from a place lateral to the heat roller 31 toward the terminal 322 of the halogen lamp 32 and the bearing 53 (step S1). Gas forming this cooling wind absorbs heat from the terminal 322 and the bearing 53 and is then guided outwardly into the relay duct 35 provided outside the drying chamber 50 (step S2). Next, the gas in the relay duct 35 is guided inwardly by the gas inward guide unit 36 into the space external to the heat roller 31 and inside the drying chamber 50 (step S3). The gas guided inwardly into the drying chamber 50 is supplied by the gas supply unit 38 to the arc-shaped space 54 between the heat roller 31 and the guide plate 37 (step S4). Then, the gas in the arc-shaped space 54 is released to the outside of the outer housing 100 by the gas exhaust unit 39 (step S5).

Specifically, in the drying device 30, the high-temperature gas with the heat absorbed from the terminal 322 of the halogen lamp 32 and the bearing 53 passes through the relay duct 35, the gas inward guide unit 36 and the gas supply unit 38 to be supplied to the arc-shaped space 54. Thus, temperature drop of the outer peripheral surface of the heat roller 31 is reduced, compared to supplying gas at ordinary temperature to the arc-shaped space 54. This achieves higher efficiency of drying with the heat roller 31. This also contributes to reduction in power to be consumed by the halogen lamp 32 for keeping the outer peripheral surface of the heat roller 31 at constant temperature.

In the drying device 30, the gas supplied to the arc-shaped space 54 is released to the outside of the outer housing 100 by the gas exhaust unit 39. Thus, the high-temperature gas with the heat absorbed from the terminal 322 of the halogen lamp 32 and the bearing 53 will be less likely to diffuse in the outer housing 100 of the printing apparatus 1. This reduces the probability of damage on various structures in the outer housing 100 with heat.

As shown in FIG. 4, the gas supply fans 381 of this preferred embodiment feed gas not vertically to the outer peripheral surface of the heat roller 31 but toward positions slightly downstream of the gas supply fans 381 in the transport direction. This achieves more efficient replacement of gas in the arc-shaped space 54. As a result, drying with the heat roller 31 proceeds more efficiently.

As described above, in this preferred embodiment, the opposite end portions of the arc-shaped space 54 in the width direction are closed with the blades 371 in a pair. By doing so, diffusion of gas is reduced further in the arc-shaped space 54. This achieves still more efficient replacement of gas in the arc-shaped space 54. As a result, drying with the heat roller 31 proceeds still more efficiently.

In this preferred embodiment, the gas exhaust ducts 392 are connected to the opposite end portions of the suction part 391 in the width direction. Thus, power of sucking gas per unit area is larger at the opposite end portions and their neighborhoods of the suction part 391 in the width direction than at the center and its neighborhood of the suction part 391 in the width direction. In this regard, in this preferred embodiment, the suction holes 394 of the suction part 391 have sizes that become larger gradually from the opposite end portions toward the center of the suction part 391 in the width direction, as shown in FIG. 6. Thus, a suction hole 394 arranged at the center in the width direction is larger than suction holes 394 arranged at the opposite end portions in the width direction.

This makes it possible to suck the substantially same amount of gas through suction holes 394 at the center and its neighborhood in the width direction and through suction holes 394 at the opposite end portions and their neighborhoods in the width direction, even in the presence of the aforementioned difference in suction power. Specifically, a uniform amount of suction is achieved in the width direction for gas to be sucked from the arc-shaped space 54 into the suction part 391. This allows ink adhering to the printing paper 9 to be dried in a uniform condition in the width direction.

The flow of gas shown in the flowchart of FIG. 7 is always formed during implementation of the drying process on the printing paper 9 with the heat roller 31. However, if the heat roller 31 stops rotating in an interval between the printing processes, for example, it is desirable that the operations of the gas supply fans 381 be also stopped. Specifically, it is desirable that the controller 40 operate the gas supply fans 381 only when the heat roller 31 rotates. By doing so, gas is prevented from blowing intensively on a partial area of the outer peripheral surface of the heat roller 31. This prevents reduction in temperature uniformity on the outer peripheral surface of the heat roller 31.

<3. Modifications>

The present invention is not limited to the aforementioned one preferred embodiment of the present invention.

In the aforementioned preferred embodiment, the gas inward guide unit includes the inward guide fan. However, the inward guide fan may be omitted and the gas inward guide unit may be configured merely as an opening. This configuration can be employed by forming a gas flow at the gas inward guide unit by means of a gas pressure difference generated by a different fan.

In the aforementioned preferred embodiment, the halogen lamp is used as the heat source for the heat roller. However, the halogen lamp can be replaced by a different heat generator to function as the heat source.

In the aforementioned preferred embodiment, cooling wind from the cooling unit is to blow on the terminal and the bearing. However, the cooling wind may blow on a different part near the heat source.

The printing apparatus of the aforementioned preferred embodiment is to print an image on printing paper as a printing medium. However, the printing medium of the present invention may be a sheet-like recording medium (a film made of resin, for example) other than a generally-used printing medium made of paper.

The components described in the aforementioned preferred embodiment and the modifications may be consistently combined together, where appropriate.

What is claimed is:

1. A drying device installed on a printing apparatus that records an image on an elongated strip-shaped printing medium by an inkjet system, the drying device being for drying ink adhering to the printing medium, the drying device comprising:

a drying chamber provided in said printing apparatus;

a heat roller that rotates about a rotation axis extending parallel to a width direction of the printing medium while supporting the printing medium on an outer peripheral surface of the heat roller in said drying chamber;

a heat source provided in said heat roller;

a cooling unit that feeds cooling wind from a place lateral to said heat roller toward a part near said heat source;

a gas outward guide unit that guides gas outwardly from the part near said heat source to the outside of said drying chamber;

a gas inward guide unit that guides gas inwardly into space external to said heat roller and inside said drying chamber, the inwardly-guided gas being the gas guided outwardly by said gas outward guide unit;

a gas supply unit that supplies gas to a neighborhood of the outer peripheral surface of said heat roller, the supplied gas being the gas guided inwardly by said gas inward guide unit; and a gas exhaust unit that releases gas from a surrounding of said heat roller to the outside of said printing apparatus.

2. The drying device according to claim 1, further comprising a relay duct provided outside a side wall of said drying chamber, wherein said gas outward guide unit guides gas outwardly from the part near said heat source toward the inside of said relay duct, and said gas inward guide unit guides gas inwardly from the inside of said relay duct toward the inside of said drying chamber.

3. The drying device according to claim 1, further comprising a guide plate extending along the outer peripheral surface of said heat roller, wherein said gas supply unit supplies gas to arc-shaped space between the outer peripheral surface of said heat roller and said guide plate, and said gas exhaust unit releases gas from said arc-shaped space to the outside of said printing apparatus.

4. The drying device according to claim 3, wherein said guide plate includes blades in a pair arranged at opposite end portions of said arc-shaped space in the width direction.

5. The drying device according to claim 3, wherein said gas exhaust unit includes:

a suction part with a plurality of suction holes through which gas is sucked from said arc-shaped space; and a gas exhaust duct connecting each of opposite end portions of said suction part in the width direction and the outside of said printing apparatus, said suction holes are arranged in the width direction, and said suction holes include a suction hole arranged at the center of said suction part in the width direction and suction holes arranged at the opposite end portions of said suction part in the width direction, the suction hole at the center being larger than the suction holes at the opposite end portions.

6. The drying device according to claim 3, wherein said gas supply unit includes a plurality of fans arranged in the width direction, each of the fans feeding gas to said arc-shaped space.

7. The drying device according to claim 6, wherein said gas exhaust unit is arranged downstream of said gas supply unit on a transport path of the printing medium, and said fans feed gas toward positions downstream of said fans on said the transport path.

8. The drying device according to claim 6, further comprising a controller that controls operation of said heat roller and operation of said fans, wherein said controller operates said fans only when said heat roller rotates.

9. The drying device according to claim 1, further comprising a bearing that rotatably supports said heat roller, wherein said cooling unit feeds cooling wind toward said heat source and said bearing.

10. A printing apparatus that records an image on an elongated strip-shaped printing medium by an inkjet system, the printing apparatus comprising:

a recording head that ejects ink toward a surface of the printing medium; and the drying device as recited in claim 1, wherein said drying device is located downstream of said recording head on a transport path.

11. A drying method of drying ink adhering to an elongated strip-shaped printing medium in a drying chamber in a printing apparatus that records an image on the printing medium by an inkjet system, the method drying the ink by making the printing medium contact an outer peripheral surface of a heat roller including a built-in heat source, the method comprising the steps of:

a) feeding cooling wind from a place lateral to said heat roller toward a part near said heat source;

b) guiding gas outwardly from the part near said heat source to the outside of said drying chamber;

c) guiding gas inwardly into space external to said heat roller and inside said drying chamber, the inwardly-guided gas being the gas guided outwardly in said step b);

d) supplying gas to a neighborhood of the outer peripheral surface of said heat roller, the supplied gas being the gas guided inwardly in said step c); and e) releasing gas from a surrounding of said heat roller to the outside of said printing apparatus.

12. The drying method according to claim 11, wherein in said step b), gas is guided outwardly from the part near said heat source toward the inside of a relay duct provided outside a side wall of said drying chamber, and in said step c), gas is guided inwardly from the inside of said relay duct toward the inside of said drying chamber.

13. The drying method according to claim 11, wherein in said step d), gas is supplied to arc-shaped space between the outer peripheral surface of said heat roller and a guide plate extending along the outer peripheral surface of said heat roller, and in said step e), gas is released from said arc-shaped space to the outside of said printing apparatus.

14. The drying method according to claim 11, wherein in said step d), gas is supplied to the neighborhood of the outer peripheral surface of said heat roller by a plurality of fans.

15. The drying method according to claim 14, wherein in said step d), said fans are operated only when said heat roller rotates.

* * * * *